US012644166B2

(12) United States Patent
Ma et al.

(10) Patent No.: US 12,644,166 B2
(45) Date of Patent: Jun. 2, 2026

(54) HIGH-THERMAL CONDUCTIVITY COMPOSITE MATERIAL, PREPARATION METHOD AND APPLICATION THEREOF

(71) Applicants: XI'AN JIAOTONG UNIVERSITY, Xi'an (CN); Shaanxi Zinc Industry Co., Ltd, Shangluo (CN)

(72) Inventors: Shengqiang Ma, Xi'an (CN); Ping Lv, Xi'an (CN); Xudong Cui, Shangluo (CN); Yusheng Liu, Xi'an (CN); Xuebin He, Shangluo (CN); Jiaxu Chen, Xi'an (CN); Jiankang Zhang, Shangluo (CN); Jiandong Xing, Xi'an (CN); Wenmin Niu, Shangluo (CN)

(73) Assignees: Xi'an Jiaotong University, Xi'an (CN); Shaanxi Zinc Industry Co., Ltd, Shangluo City (CN)

( * ) Notice: Subject to any disclaimer, the term of this patent is extended or adjusted under 35 U.S.C. 154(b) by 390 days.

(21) Appl. No.: 18/542,502

(22) Filed: Dec. 15, 2023

(65) Prior Publication Data

US 2024/0117470 A1 Apr. 11, 2024

(30) Foreign Application Priority Data

Sep. 18, 2023 (CN) ..... 202311204852.8

(51) Int. Cl.

| | |
|---|---|
| ***C22C 18/04*** | (2006.01) |
| ***B21C 23/00*** | (2006.01) |
| ***C22C 1/10*** | (2023.01) |
| ***C22C 32/00*** | (2006.01) |

(52) U.S. Cl.

CPC ..... *C22C 18/04* (2013.01); *B21C 23/002* (2013.01); *C22C 1/1047* (2023.01); *C22C 32/0068* (2013.01)

(58) Field of Classification Search

CPC ..... C22C 28/04; C22C 32/0068; C22C 18/04; C22C 1/1047; C22F 1/165; B21C 23/002

See application file for complete search history.

(56) References Cited

FOREIGN PATENT DOCUMENTS

| | | | | |
|---|---|---|---|---|
| CN | 111304507 A | | 6/2020 | |
| CN | 116179893 A | | 5/2023 | |
| CN | 117051291 A | * | 11/2023 | ..... C22C 18/00 |

* cited by examiner

*Primary Examiner* — Jessee R Roe

(57) ABSTRACT

A high-thermal conductivity composite material is $AlN_p$/ZA27 composite material, including 2%, 4%, 6%, or 8% by volume of aluminum nitride (AlN) ceramic particles and zinc-aluminium-27 (ZA27) alloy. The ZA27 alloy includes 70.52-71.08% by weight of Zn, 25.58~27.65% by weight of Al, 1.27~3.45% by weight of Cu, and 0.50% or less by weight of Mg. In the preparation of the high-thermal conductivity composite material, an as-cast $AlN_p$/ZA27 composite material is subjected to homogenizing annealing and reciprocating extrusion.

9 Claims, 7 Drawing Sheets

HIGH-THERMAL CONDUCTIVITY COMPOSITE MATERIAL, PREPARATION METHOD AND APPLICATION THEREOF

CROSS-REFERENCE TO RELATED APPLICATIONS

This application claims the benefit of priority from Chinese Patent Application No. 202311204852.8, filed on Sep. 18, 2023. The content of the aforementioned application, including any intervening amendments thereto, is incorporated herein by reference in its entirety.

TECHNICAL FIELD

This application relates to microelectronic packaging materials, and more particularly to a high-thermal conductivity composite material, and a preparation method and application thereof.

BACKGROUND

The popularization of fifth-generation (5G) technology has greatly promoted the development of consumer electronics toward high power, high integration, light weight, and high intelligence. The continuous increase in the integration level, power density and assembly density make the thermal management of the electronic devices increasingly prominent in the 5G era. For the commonly-used Si semiconductor and GaAs semiconductor, every 10° C. rise will cause the probability of chip failure to rise to three times as high as before. Hence, a packaging material with excellent thermal conductivity and low thermal expansion coefficient is crucial for enhancing chip performance and extending the service life of the chip. At present, the chip packaging materials widely used include epoxy glass, ceramics, metals, and metal matrix composites. Among them, particle-reinforced metal matrix composites used in thermal management materials have attracted extensive attention. The particle reinforcement with high thermal conductivity and low thermal expansion coefficient is compounded with metal to obtain composite materials with excellent thermal conductivity and integrated mechanical properties. Zinc-aluminum alloys (Zn—Al alloy, ZA series) have been widely used in many fields due to excellent castability, wear resistance and thermal conductivity. ZA27 is the strongest of all the ZA alloys and has been used to replace the traditional casting alloys such as Al, Cu, and so on in various engineering applications. Compared with the traditional casting Al alloys and Cu alloys, ZA alloys have better machinability, higher damping performance, lower melting point, lower melting cost and excellent molding precision, which have a broad use prospect in the electronic packaging materials. However, the theoretical thermal expansion coefficient of ZA27 alloy is $26.0\times10^{-6}$/K, which is too high for the chip and easy to produce a large thermal mismatch stress to cause the chip failure. Hence, it is necessary to compound the ZA27 alloy with an inorganic material with low thermal expansion coefficient make the thermal expansion coefficient adapt to the chip materials. AlN is a heat-resistant ceramic phase, which belongs to diamond-like nitrides. Owing to the good thermal conductivity and mechanical properties, AlN ceramic particles can be introduced to ZA27 alloy to improve the thermal conductivity and mechanical properties of ZA27 alloy and reduce the thermal expansion coefficient of ZA27 alloy.

The morphology and distribution of ceramic particles have a crucial effect on the properties of the particle-reinforced composites, so the large plastic deformation is introduced to deform the as-cast composites. In the large plastic deformation process, a large strain is introduced to effectively refine matrix grains (forming sub-micron or nano-scale grains), and to obtain the large-size bulk ultra-fine-grained materials with the high strength and large plasticity by controlling the microstructure in the deformation process. Large plastic deformation technology mainly includes equal channel angular pressing (ECAP), high-pressure torsion (HPT), reciprocating extrusion (RE). The RE process can effectively eliminate various casting defects in the original microstructure of materials, improve the distribution of reinforcements, and can continuously and repeatedly preform upset-extrusion deformation. Moreover, bulk composite materials with large and controllable size can also be prepared. In this application, the cast $AlN_p$/ZA27 composite material is deformed by the RE technology to prepare the composite materials with excellent comprehensive performance, so as to accelerate the application of high-thermal conductivity zinc alloy in the microelectronic packaging materials.

SUMMARY

In view of the deficiencies in the prior art, this application provides a high-thermal conductivity composite material, and a preparation method and application thereof, for solving the technical problem that the existing composite materials fail to combine high strength and high thermal conductivity, and the single material has poor comprehensive performance.

Technical solutions of this application are described as follows.

In a first aspect, this application provides a thermally-conductive composite material, wherein the thermally-conductive composite material is an $AlN_p$/ZA27 composite material comprising 2%, 4%, 6%, or 8% by volume fraction (i.e., vol %) of AlN ceramic particles.

In an embodiment, the thermally-conductive composite material further comprises a ZA27 alloy; and the ZA27 alloy comprises 70.52-71.08% by weight of Zn, 25.58~27.65% by weight of Al, 1.27~3.45% by weight of Cu, and 0.50% or less by weight of Mg.

In an embodiment, a size of each of the AlN ceramic particles is 0.5~1.2 μm.

In a second aspect, this application provides a method of preparing the thermally-conductive composite material, comprising: subjecting an as-cast $AlN_p$/ZA27 composite material to reciprocating extrusion to produce the thermally-conductive composite material.

In an embodiment, the method further comprises: performing homogenizing annealing on the as-cast $AlN_p$/ZA27 composite material before the reciprocating extrusion.

In an embodiment, the reciprocating extrusion comprises: performing a first-pass extrusion at a temperature of 250~350° C. and an extrusion rate of 0.15~0.56 mm/s in a mold for 0.5~1 h.

In an embodiment, a heating coil is provided for heating the mold; and a refractory cotton is wrapped around the heating coil.

In an embodiment, the reciprocating extrusion further comprises:

after the first-pass extrusion is completed, turning the mold by 180°, and keeping the mold at 250~350° C. for 10~30 min; and performing a second-pass extrusion, and repeating such process until a multi-pass extrusion is completed, so as to obtain the thermally-conductive composite material.

In an embodiment, the number of passes in the multi-pass extrusion is 4-16.

In an embodiment, the as-cast $AlN_p$/ZA27 composite material is prepared through steps of:

melting the ZA27 alloy at 560° C.-620° C. to obtain a melted ZA27 alloy;

adding the AlN ceramic particles into the melted ZA27 alloy followed by stirring for 3-5 minutes to obtain a mixture; and pouring the mixture into a graphite mold at 540° C.-560° C. for molding to obtain the as-cast $AlN_p$/ZA27 composite material.

In some embodiments, the homogenizing annealing is performed at 200° C. for 6 h.

In a third aspect, this application provides an application of the high-thermal conductivity composite material in the packaging materials of microelectronics and 5G devices.

Compared to the prior art, this application has the following beneficial effects.

Referring to the Zn—Al phase diagram, in the as-cast $AlN_p$/ZA27 composite material, the ZA27 alloy will form a primary α-Al phase, a β-Zn phase, and a (β+η) eutectic structure during the solidification process. The primary α-Al phase and the β-Zn phase will decompose into the (α+η) eutectoid microstructure during the cooling process to room temperature. The addition of the AlN reinforced phase can significantly refine the grains of ZA27 alloy and improve the hardness of the alloy. The content of AlN particles is 2.0~8.0 vol %, which has a beneficial effect on the microstructures and thermal conductivity of $AlN_p$/ZA27 high-thermal conductivity composites, and at the same time, ensures the volume fraction of AlN reinforced phases, thereby significantly improving the mechanical properties of the composite materials.

In the preparation method of the high-thermal conductivity composite materials, the as-cast $AlN_p$/ZA27 composite materials are subjected to reciprocating extrusion deformation. In the reciprocating extrusion process under hot deformation, the comprehensive effects of "continuous upsetting extrusion, kneading, crushing processes of the composite materials" are achieved, and the dynamic recrystallization occurs in alloy matrix, thereby forming a large number of undistorted equiaxed grains, significantly refining the grain size, and improving the mechanical properties of $AlN_p$/ZA27 composite materials. Besides, the significant strip microstructure is formed during reciprocating extrusion (RE) process. That is, the α-Al phase is uniformly distributed on the η-Zn matrix in an undistorted equiaxed grain form, and AlN ceramic particles are partially broken and distributed along the extrusion direction, which effectively improves the thermal conductivity of the alloy along the direction of extrusion. For further developing high-thermal conductivity composites that can be reliably used in microelectronics encapsulation, this application significantly refines the grain size of $AlN_p$/ZA27 composite materials and improves the distribution of AlN reinforced phase, which plays the dual reinforcing effect of fine-grained strengthening and second phase strengthening and has the high-thermal conductivity, thereby enhancing heat transfer.

The homogenizing annealing can effectively eliminate the compositional segregation in the as-cast $AlN_p$/ZA27 composite materials and improve the microstructural uniformity of the composite materials.

After the as-cast $AlN_p$/ZA27 composite materials are subjected to homogenizing annealing, the as-cast $AlN_p$/ZA27 composite materials are turned and processed to a suitable size for the mold, placed into a reciprocating extrusion mold, kept the extrusion mold at 250~350° C. for 0.5~1 h, and performed the single-pass extrusion at the extrusion rate of 0.15~0.56 mm/s. After the single-pass extrusion is completed, the extrusion mold is turned by 1800 and kept at 250~350° C. for 10~30 min, to perform the multi-pass extrusion to obtain the reciprocating extrusion $AlN_p$/ZA27 composite materials.

The melting point of ZA27 alloy is about 509° C., so the extrusion temperature is set to 250° C.~350° C., so that α-Al, η-Zn dendrites are broken during reciprocating extrusion hot deformation process, and dynamic recrystallization simultaneously occurs during the extrusion process, and a large number of undistorted equiaxed grains are completely formed, and at the same time, the mechanical property and thermal conductivity of the composite materials is greatly improved. The Zn dendrites have HCP crystal structure that the deformation process is difficult to occur. Therefore, the temperature is heated to 250~350° C. and held at 250~350° C. for 0.5~1 h, which can effectively improve the plasticity of Zn dendrites and prevent the composite materials from cracking and other forming defects during reciprocating extrusion. The extrusion rate is set to 0.15~0.56 mm/s, which can make the reciprocating extrusion billets undergo sufficient upsetting extrusion deformation, dynamic recrystallization, and make the plastic flow of the materials in the extrusion process more uniform and good and also become hot deformable and formable.

The refractory cotton is used to insulate the extrusion mold during the heating process to reduce the heat dissipation of the mold, the heating time and improve the heating efficiency of the $AlN_p$/ZA27 composite material billet in the mold.

After completing one-pass extrusion, the extrusion mold is turned by 180° and kept heat for 10~30 min, and multiple reciprocating extrusions are carried out, so that the composite materials are fully deformed and recrystallized during reciprocating extrusion hot deformation, effectively improving the grain refinement effect, and the distribution of AlN reinforced phase.

In summary, in the reciprocating extrusion process, the extrusion temperature, extrusion rate, and heat holding time are appropriate. The reciprocating extrusion large plastic deformation technology can effectively eliminate the compositional segregation of the ca-cast $AlN_p$/ZA27 composite materials, so that the composite materials undergo dynamic recrystallization to form fine-equiaxed recrystallized grains, which effectively improves the mechanical properties of the composite materials. At the same time, the morphology of AlN ceramic particles is improved, so that the AlN ceramic particles are uniformly dispersed in the composite materials, which effectively improves the thermal conductivity of the $AlN_p$/ZA27 composite materials. The composite materials have good application prospects in the microelectronic packaging materials.

The technical solution of this application will be further described in detail below by the accompanying drawings and embodiments.

Figure 1:
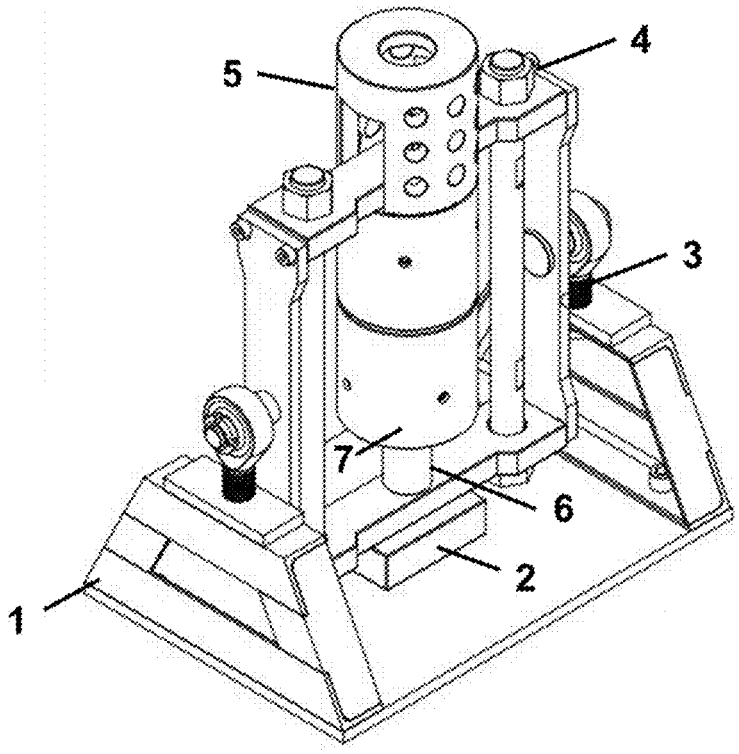
FIG. 1 is a schematic diagram of a reciprocating extrusion mold according to one embodiment of the present disclosure.
Figure 2A:
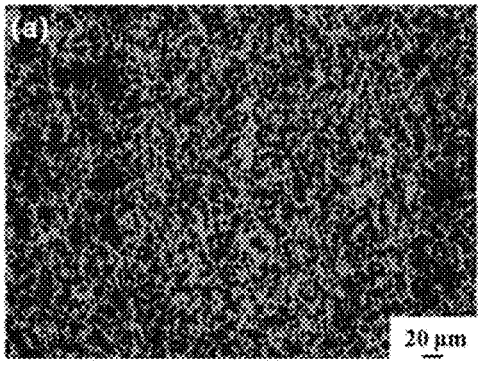
FIGS. 2*a*-2*d* are scanning electron microscope (SEM) images of grain morphology of 1 μm-8%-RE-250° C.-4PASSES; where (a) and (b) low and high magnifications of $AlN_p$/ZA27 composite material with 1 μm-8 vol % AlN-RE-250° C.-4PASSES showing more undistorted equiaxed q-Zn recrystallized grains (i.e. bright color grain in the image); (c) and (d) low and high magnifications of $AlN_p$/ZA27 composite material with 1 μm-8 vol % AlN-RE-250° C.-4PASSES showing more undistorted equiaxed α-Al recrystallized grains (i.e., dark color grain in the image).
Figure 2B:
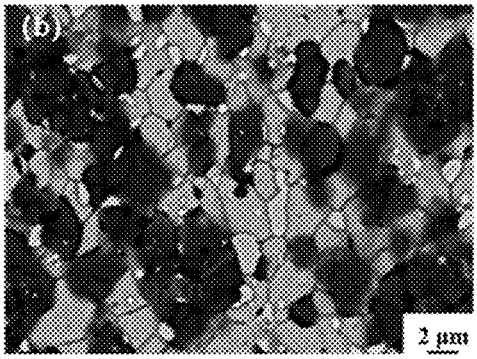
Figure 2C:
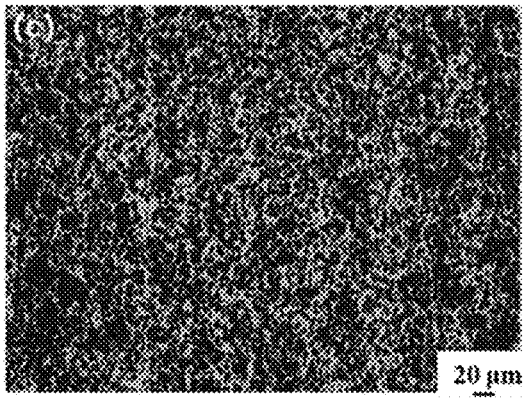
Figure 2D:
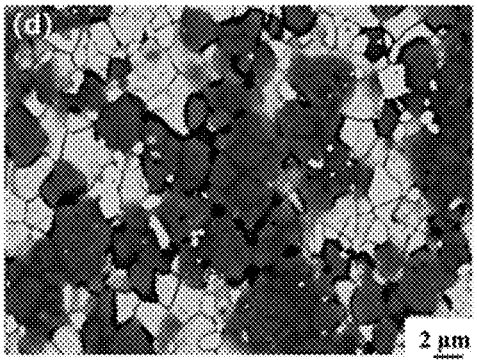

In the figures: 1—mold base; 2—cushion block; 3—buffer spring; 4—screw rod; 5—extrusion cylinder; 6—extrusion rod; and 7—mold unit.

DETAILED DESCRIPTION OF EMBODIMENTS

The technical solutions of the disclosure will be described clearly and completely below. Obviously, the described embodiments are merely some embodiments of the present disclosure, which are not intended to limit the disclosure. For those skilled in the art, other embodiments obtained based on these embodiments without paying creative efforts should fall within the scope of the disclosure.

In the disclosure, unless expressly specified otherwise, all the embodiments involved herein as well as the preferred implementation methods can be combined with each other to form new technical solutions.

In the disclosure, unless expressly specified otherwise, all technical features involved herein as well as preferred features can be combined with each other to form new technical solutions.

In the disclosure, unless expressly specified otherwise, the percentage (%) or part refers to the weight percentage or weight part relative to the composition.

In the disclosure, unless expressly specified otherwise, the components involved herein, or preferred components may be combined with each other to form new technical solutions.

In the disclosure, unless expressly specified otherwise, the value range "α-b" denotes an abbreviated form of any combination of real numbers between a and b, where both a and b are real numbers. For example, the value range "6~22" means that all real numbers between "6~22" have been listed herein, and "6~22" is only an abbreviated representation of the combination of these values.

The "range" disclosed herein may be one or more lower limits and one or more upper limits in the form of lower and upper limits, respectively.

In the disclosure, the term "and/or" as used herein refers to any combination and all possible combinations of one or more of the listed items.

In the disclosure, unless expressly specified otherwise, the individual reactions or steps may be performed sequentially. Preferably, the reaction methods herein are performed sequentially.

Unless expressly specified otherwise, technical terms used herein have the same meaning as those familiar to those skilled in the art. In addition, any method or material similar or equivalent to what is documented in this disclosure may also be applied in the disclosure.

Provided herein is a high-thermal conductivity composite material and preparation method and application thereof. The as-cast $AlN_p$/ZA27 composite materials are used as the raw materials, and the final product is processed by multi-pass reciprocating extrusion large plastic deformation process. By introducing ceramic reinforced phases with strengthening effect and high-thermal conductivity, and by refining the matrix grains and improving the distribution of the reinforced phases through large plastic deformation, the as-cast $AlN_p$/ZA27 composite materials are deformed by reciprocating extrusion to improve the morphology, thermal conductivity, and mechanical properties of the $AlN_p$/ZA27 composite materials. According to Zn—Al phase diagram, α-Al phase, η-Zn phase, and AlN ceramic particle reinforced phase with high-thermal conductivity exist in the reciprocating extrusion $AlN_p$/ZA27 composite materials. After reciprocating extrusion, the α-Al phase and η-Zn phase undergoes dynamic recrystallization, the grains are obviously refined as undistorted and equiaxed recrystallized grains, and the AlN ceramic particles are broken and uniformly distributed along the extrusion direction. The mechanical properties and thermal conductivity of the composite materials are significantly improved under the effect of the fine grain reinforcement and second phase reinforcement.

The high-thermal conductivity composite materials are expressed as $AlN_p$/ZA27. The volume fraction (φ) of AlN ceramic particles in the composite is equal to 2%, 4%, 6%, 8%, respectively.

By mass percentage, the ZA27 matrix alloy includes 70.52~71.08% by weight of Zn, 25.58~27.65% by weight of Al, 1.27~3.45% by weight of Cu, and 0.50 or less by weight of Mg. The particle size of the reinforcement AlN ceramic particles is 0.5-1.2 μm.

A method of preparing the high-thermal conductivity composite materials includes the following steps.

(S1) The as-cast $AlN_p$/ZA27 composite materials are subjected to homogenizing annealing at 200° C. for 6 hours, and turning machining to fit the inner cavity of the extrusion mold.

(S2) The $AlN_p$/ZA27 composite materials obtained in step (S1) as the raw materials are placed into the reciprocating extrusion mold. The clamp, the extrusion rod, the heating coil of the mold are mounted and connected with a reciprocating extrusion support. The reciprocating extrusion mold is pre-pressed by the hydraulic machine to eliminate the gap between the billet and the reciprocating extrusion mold.

(S3) The heating coil and thermocouples as well as the temperature-controlled meter are connected to the temperature control device. The refractory cotton is wrapped outside the heating coil. The heating temperature is set as 250~350° C. to start heating.

(S4) The billet is heated to 250~350° C. and held for 0.5~1 h, and then the hydraulic machine is started to complete the first-pass extrusion at an extrusion rate of 0.15~0.56 mm/s.

(S5) The reciprocating extrusion mold is flipped, heated to the preset temperature and held for 10~30 min. After that, the hydraulic machine is started to complete a second-pass extrusion at an extrusion rate of 0.15~0.56 mm/s. The extrusion is repeated for 4, 8, 12 or 16 passes until the reciprocating extrusion process is completed.

(S6) The reciprocating extrusion mold is disassembled, and placed on the sleeve with a set of die separation tools, and the hydraulic machine is started to extrude the as-extruded billets to obtain the $AlN_p$/ZA27 composite materials.

The high-thermal conductivity composite materials of the disclosure can be applied in microelectronics and 5G device packaging materials.

The high-thermal conductivity composite materials of the disclosure are mainly applied to the metal encapsulation housing of chips with high airtightness requirements, which has better heat dissipation performance and electromagnetic shielding performance and is suitable for the encapsulation of high-power and high-frequency devices.

Further, the high-thermal conductivity composite materials of the disclosure are also applied to radiators of automobiles, electronic components, and high-power LED lampshade, effectively controlling and dispersing heat to ensure that the devices do not fail due to overheating. The high-thermal conductivity composite materials are the new materials for high-end thermal management.

The present disclosure will be further described in detail below in conjunction with the accompanying drawings and embodiments to understand the objects, technical solutions, and advantages of the present disclosure more clearly. Obviously, described below are merely some embodiments of the disclosure, which are not intended to limit the disclosure. It should be noted that the components in the embodiments and the drawings herein may be arranged and designed in different forms. Accordingly, the following detailed description is merely illustrative, and is not intended to limit the scope of the disclosure. For those skilled in the art, other embodiments obtained based on these embodiments without paying creative efforts should fall within the scope of the disclosure defined by the appended claims.

Embodiment 1

The ZA27 alloy was melted at 560° C.-620° C., added with AlN ceramic particles and stirred for 3-5 minutes to obtain a mixture, where the AlN ceramic particles were added such that the composite included 4% by volume of AlN. The mixture was poured into a graphite mold at 540° C.-560° C. for molding to obtain the as-cast $AlN_p$/ZA27 composite material.

The $AlN_p$/ZA27 composite material with 4% by volume of AlN was subjected to homogenization annealing at 200° C. for 6 hours, and turning machining to fit the inner cavity of the extrusion mold. After that, the $AlN_p$/ZA27 composite material was loaded into the extrusion mold, and the extrusion mold was assembled, heated to 250° C. and kept for 30 min. The hydraulic machine was started to perform a single-pass extrusion at an extrusion rate of 0.15 mm/s. Then, the extrusion mold was turned, and kept at 250° C. for 10 min, and the hydraulic machine was started to perform the second-pass extrusion at an extrusion rate of 0.15 mm/s, and then the above-mentioned process was repeated. After the fourth-pass extrusion was completed, the extrusion mold was dissembled, and a 4%-250° C.-4PASSES-AlN/ZA27 composite material was obtained by demolding.

Embodiment 2

An $AlN_p$/ZA27 composite material with 4% by volume of AlN was subjected to homogenization annealing at 200° C. for 6 hours, and turning machining to fit the inner cavity of the extrusion mold. After that, the $AlN_p$/ZA27 composite material was loaded into the extrusion mold, and the extrusion mold was assembled, heated to 300° C. and kept for 1 h. The hydraulic machine was started to perform a single-pass extrusion at an extrusion rate of 0.15 mm/s. Then, the extrusion mold was turned, and kept at 300° C. for 15 min, and the hydraulic machine was started to perform the second-pass extrusion at an extrusion rate of 0.15 mm/s, and then the above-mentioned process was repeated. After the fourth-pass extrusion was completed, the extrusion mold was dissembled, and a 4%-300° C.-4PASSES-AlN/ZA27 composite material was obtained by demolding.

Embodiment 3

An $AlN_p$/ZA27 composite material with 8% by volume of AlN was subjected to homogenization annealing at 200° C. for 6 hours, and turning machining to fit the inner cavity of the extrusion mold. After that, the $AlN_p$/ZA27 composite material was loaded into the extrusion mold, and the extrusion mold was assembled, heated to 250° C. and kept for 1 h. The hydraulic machine was started to perform a single-pass extrusion at an extrusion rate of 0.50 mm/s. Then, the extrusion mold was turned, and kept at 250° C. for 20 min, and the hydraulic machine was started to perform the second-pass extrusion at an extrusion rate of 0.50 mm/s, and then the above-mentioned process was repeated. After the fourth-pass extrusion was completed, the extrusion mold was dissembled, and an 8%-250° C.-4PASSES-AlN/ZA27 composite material was obtained by demolding.

Embodiment 4

An $AlN_p$/ZA27 composite material with 8% by volume of AlN was subjected to homogenization annealing at 200° C. for 6 hours, and turning machining to fit the inner cavity of the extrusion mold. After that, the $AlN_p$/ZA27 composite material was loaded into the extrusion mold, and the extrusion mold was assembled, heated to 300° C. and kept for 30 min. The hydraulic machine was started to perform a single-pass extrusion at an extrusion rate of 0.36 mm/s. Then, the extrusion mold was turned, and kept at 300° C. for 10 min, and the hydraulic machine was started to perform the second-pass extrusion at an extrusion rate of 0.36 mm/s, and then the above-mentioned process was repeated. After the eighth-pass extrusion was completed, the extrusion mold was dissembled, and an 8%-300° C.-8PASSES-AlN/ZA27 composite material was obtained by demolding.

Embodiment 5

An $AlN_p$/ZA27 composite material with 2% by volume of AlN was subjected to homogenization annealing at 200° C. for 6 hours, and turning machining to fit the inner cavity of the extrusion mold. After that, the $AlN_p$/ZA27 composite material was loaded into the extrusion mold, and the extrusion mold was assembled, heated to 250° C. and kept for 30 min. The hydraulic machine was started to perform a single-pass extrusion at an extrusion rate of 0.40 mm/s. Then, the extrusion mold was turned, and kept at 250° C. for 30 min, and the hydraulic machine was started to perform the second-pass extrusion at an extrusion rate of 0.40 mm/s, and then the above-mentioned process was repeated. After the fourth-pass extrusion was completed, the extrusion mold was dissembled, and a 2%-250° C.-4PASSES-AlN/ZA27 composite material was obtained by demolding.

FIG. 1 is a schematic diagram of the reciprocating extrusion mold. The reciprocating extrusion mold mainly includes a mold base 1, a cushion block 2, a buffer spring 3, a screw rod 4 to fasten a mold support, an extrusion cylinder as U-type extrusion rod (i.e., driving a mold unit to move down to accomplish the counter motion of billet) 5, an extrusion support rod 6, and a mold unit (i.e., containers of extrusion billet) 7. The reciprocating extrusion is carried out by first placing the extrusion billets into the mold unit 7 and fixing the two mold units (i.e., containers of extrusion billet) 7 through the clamps, followed by placing the extrusion support rod 6 from both ends of the extrusion mold and connecting the extrusion support rod 6 with the mold support through the screws. After completing the connection between the extrusion support rod 6 and the mold support frame, the screw 4 is tightened, and the cushion block 2 and the extrusion cylinder 5 are placed in sequence to complete the subsequent extrusion process.

FIGS. 2*a*-2*d* show grain morphology of 1 μm-8%-RE-250° C.-4PASSES, where RE represents reciprocal extrusion; and PASS represents the number of extrusion passes; and 1 μm represents the size of added AlN in the composites; and 8% represents the volume fraction of AlN in the composites; and 250° C. represents the extrusion temperature. After four passes of reciprocating extrusion at 250° C., 1 μm-8% AlN/ZA27 sample showed obvious thermal processing flow lines. The original dendrites in the as-cast composite materials were broken, and the α-Al phase and η-Zn phase underwent dynamic recrystallization to form undistorted and equiaxed recrystallized grains, wherein α-Al (i.e., dark color grain) is the phase with darker lining in the FIGS. 2*a*-2*d*, and η-Zn (i.e., light color grain) is the phase with lighter lining in the FIGS. 2*a*-2*d*, and it can be observed that α-Al was distributed in a mesh-like manner on the f-Zn matrix. Moreover, the grains are obviously refined and equiaxed after subjecting to reciprocating extrusion, and most of grains are recrystallized grains. The grain size is only about 1 μm. The mechanical properties of the composite materials are effectively improved.

Figure 3A:
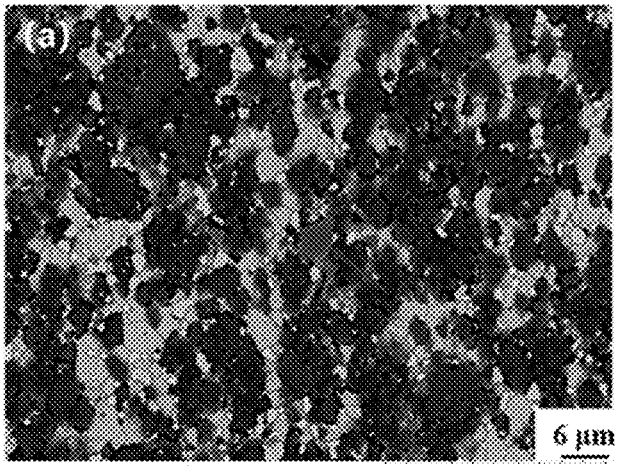
FIGS. 3*a* and 3*b* are SEM images of AlN morphology and distribution: 1 μm-8%-RE-250° C.-4PASSES; where (a) and (b) low and high magnifications of $AlN_p$/ZA27 composite material with 1 μm-8 vol % AlN-RE-250° C.-4PASSES showing some AlN morphologies in the microstructures (i.e., rhombic and square AlN particles with grey color distributed over matrix grains).
Figure 3B:
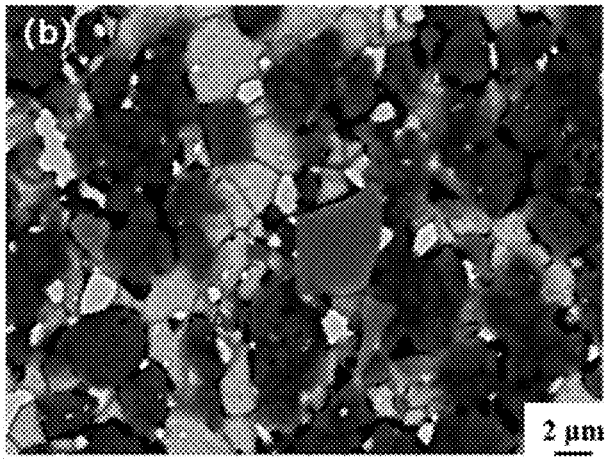

FIGS. 3*a* and 3*b* show morphology and distribution of AlN ceramic particles in 1 μm-8%-RE-250° C.-4PASSES, where RE represents reciprocal extrusion; and PASS represents the number of extrusion processes, as mentioned above. The grain size of the AlN ceramic particles is about 1 μm, and some of the AlN particles are broken during the reciprocating extrusion process and tend to be distributed along the extrusion direction, which effectively improves the thermal conductivity of the composite materials.

In summary, in the high-thermal conductivity composite materials and preparation method and application thereof in this disclosure, the reciprocating extrusion large plastic deformation technology can effectively eliminate the compositional segregation of the ca-cast $AlN_p$/ZA27 composite materials, so that the composite materials undergo dynamic recrystallization to form undistorted and equiaxed recrystallized grains and significantly refine the grains, which effectively enhances the mechanical properties of the composite materials. At the same time, the morphology and distribution of the AlN ceramic particles are improved, so that the AlN ceramic particles are distributed along the extrusion direction, which effectively enhances the thermal conductivity of $AlN_p$/ZA27 composite material and has a good application prospect in the microelectronic packaging materials.

It should be noted that the above embodiments are only used to illustrate the technical solutions of the disclosure, and are not intended to limit the disclosure. It should be understood that any modifications and replacements made by those skilled in the art without departing from the spirit of the disclosure should fall within the scope of the disclosure defined by the appended claims.

What is claimed is:

1. A method of preparing a thermally-conductive composite material, comprising:

subjecting an as-cast aluminum nitride particle-reinforced zinc-aluminum alloy (AlN-ZA) composite material to reciprocating extrusion to produce the thermally-conductive composite material;

wherein the thermally-conductive composite material is AlN-ZA composite material comprising a zinc-aluminum alloy and 2%, 4%, 6%, or 8% by volume of AlN ceramic particles; and the zinc-aluminum alloy comprises 70.52-71.08% by weight of Zn, 25.58~27.65% by weight of Al, 1.27~3.45% by weight of Cu, and 0.50% or less by weight of Mg.

2. The method of claim 1, further comprising:

performing homogenizing annealing on the as-cast AlN-ZA composite material before the reciprocating extrusion.

3. The method of claim 1, wherein the reciprocating extrusion comprises:

performing a first-pass extrusion at a temperature of 250~350° C. and an extrusion rate of 0.15~0.56 mm/s in a mold for 0.5~1 h.

4. The method of claim 3, wherein a heating coil is provided for heating; and a refractory cotton is wrapped around the heating coil.

5. The method of claim 3, wherein the reciprocating extrusion further comprises:

after the first-pass extrusion is completed, turning the mold by 180°, and keeping the mold at 250~350° C. for 10~30 min; and performing a second-pass extrusion, and repeating such process until a multi-pass extrusion is completed, so as to obtain the thermally-conductive composite material.

6. The method of claim 5, wherein the number of passes in the multi-pass extrusion is 4-16.

7. The method of claim 1, wherein a size of each of the AlN ceramic particles is 0.5~1.2 μm.

8. The method of claim 1, wherein the as-cast AlN-ZA composite material is prepared through steps of:

melting the zinc-aluminum alloy at 560° C.-620° C. to obtain a melted zinc-aluminum alloy;

adding the AlN ceramic particles into the melted zinc-aluminum alloy followed by stirring for 3-5 minutes to obtain a mixture; and pouring the mixture into a graphite mold at 540° C.-560° C. for molding to obtain the as-cast AlN-ZA composite material.

9. The method of claim 2, wherein the homogenizing annealing is performed at 200° C. for 6 h.

* * * * *